United States Patent [19]

Becker

[11] 4,116,447

[45] Sep. 26, 1978

[54] METHOD AND APPARATUS FOR PRACTICING GOLF BALL CHIPPING AND PUTTING SHOTS

[76] Inventor: Albert Becker, 1536 Sunshine Ave., Port St. Lucie, Fla. 33452

[21] Appl. No.: 777,925

[22] Filed: Mar. 15, 1977

[51] Int. Cl.[2] ..... A63B 69/36

[52] U.S. Cl. ..... 273/183 B; 273/192; 273/186 C

[58] Field of Search ..... 273/186 D, 186 R, 191 R, 273/191 A, 191 B, 192, 188 R, 189 R, 183 R, 183 B, 186 C, 191

[56] References Cited

U.S. PATENT DOCUMENTS

| | | | |
|---|---|---|---|
| 2,776,836 | 1/1957 | Zadina | 273/192 |
| 3,190,658 | 6/1965 | Kane | 273/192 |
| 3,489,416 | 1/1970 | Mark | 273/191 A |

FOREIGN PATENT DOCUMENTS

| | | | |
|---|---|---|---|
| 26,125 of | 1905 | United Kingdom | 273/192 |

*Primary Examiner*—George J. Marlo
*Attorney, Agent, or Firm*—Clarence A. O'Brien; Harvey B. Jacobson

[57] ABSTRACT

A golf chipping and putting trainer having a substantially planar guide surface supported at the height of the wrists and hands of a golfer using the device in order to force the golfer to swing in a straight line while practicing chip shots and performing putting exercises.

2 Claims, 4 Drawing Figures

METHOD AND APPARATUS FOR PRACTICING GOLF BALL CHIPPING AND PUTTING SHOTS

BACKGROUND OF THE INVENTION

1. Field of the Invention

This invention relates generally to a chipping and putting trainer, and particularly to a device which will force a golfer to swing in a straight line while chipping and putting.

2. Description of the Prior Art

A major difficulty encountered by golfers is a failure to move their arms back and forth in a straight line during chipping and putting.

Various appliances useful in practicing golf strokes have been proposed, examples of which can be found in U.S. Pat. Nos: 2,706,635, issued Apr. 19, 1955, to W. S. Thomas; 2,776,836, issued Jan. 8, 1957, to A. F. Zadina; 3,623, 733, issued Nov. 30, 1971, to J. J. Cavanaugh; 3,685,835, issued Aug. 22, 1972, to R. E. Fahy; and 3,806,133, issued Apr. 23, 1974, to D. Cork. With the exception of U.S. Pat. No. 3,623,733, which provides guides for the hip movement of a golfer during a swing, these known golf practicing devices generally employ a club tethered to the framework of the applicance in order to limit movement of the club to that desired for a specific stroke, usually a putting stroke, being practiced.

Other examples of golf training devices can be found in U.S. Pat. Nos: 2,891,796, issued June 23, 1959, to W. R. Cottrell, and 3,767,204, issued Oct. 23, 1973, to H. R. Bryson. These prior art devices are similar to that disclosed in U.S. Pat. No. 3,623,733, inasmuch as they restrict movement in the hip area of the golfer during a practice swing.

SUMMARY OF THE INVENTION

It is an object of the present invention to provide a golf chipping and putting trainer which is simplier and less expensive of construction, yet rugged and versatile in performance, when compared with known gold stroke training devices.

It is another object of the present invention to provide a golf chipping and putting trainer which forces a golfer to swing in a straight line under conditions similar to those encountered on the golf course.

It is still another object of the present invention to provide a golf chipping and putting trainer which forces a golfer to swing in a straight line without the necessity of restraining the golf club being swung in any manner.

These and other objects are achieved according to the present invention by providing a golf chipping and putting trainer having: a support; and a guide mounted on the support for forcing a golfer swinging along the guide to swing in a straight line. More specifically, the guide according to the invention is arranged in such a manner as to force the golfer to bring the arms back and forth in a proper arc and in the necessary orientation at each stage of a chipping or putting stroke.

The support advantageously includes a longitudinally extending base member provided with a pair of longitudinally spaced sockets, with poles being removably disposed in the sockets and attached to the guide for supporting the guide in spaced relation above the base member. More specifically, the base member comprises a longitudinally extending plate having longitudinally spaced end portions. Mounted on this plate at the end portions thereof are pole mounting blocks, each of which mounting blocks is provided with a plurality of sockets arranged for selectively receiving the poles. Each of the sockets in a mounting block forms a pair of pole receiving sockets with a corresponding socket provided in the other of the mounting blocks. These plurality of pairs of sockets permits adjustment of the guide relative to the plate, with the latter forming a support surface for a golfer using the training device.

The guide preferably includes a longitudinally extending member coextensive with the base member and forming a planar guide surface defining a path for the hands and wrists of a golfer using the training device according to the invention. This longitudinally extending member comprises a self-supporting, longitudinally extending, planar sheet having spaced ends terminating in codirectional flanges substantially perpendicular to the plane of the sheet. Each of these flanges is provided with a plurality of holes, and the poles are each provided in an upper portion thereof with an aperture mating selectively with one of the holes provided in the associated one of the flanges. By connecting the flanges to the poles by matched pairs of the holes provided in the flanges, the guide member can be adjustably attached to the poles to accommodate golfers of different heights. Further, by using appropriate fasteners removably attaching the guide member to the poles, not only is adjustment of the height of the sheet portion of the guide member made possible, but the angle with which the planar surface of the sheet is disposed relative to the support of the device can be varied as appropriate for a particular person using the training device according to the invention.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
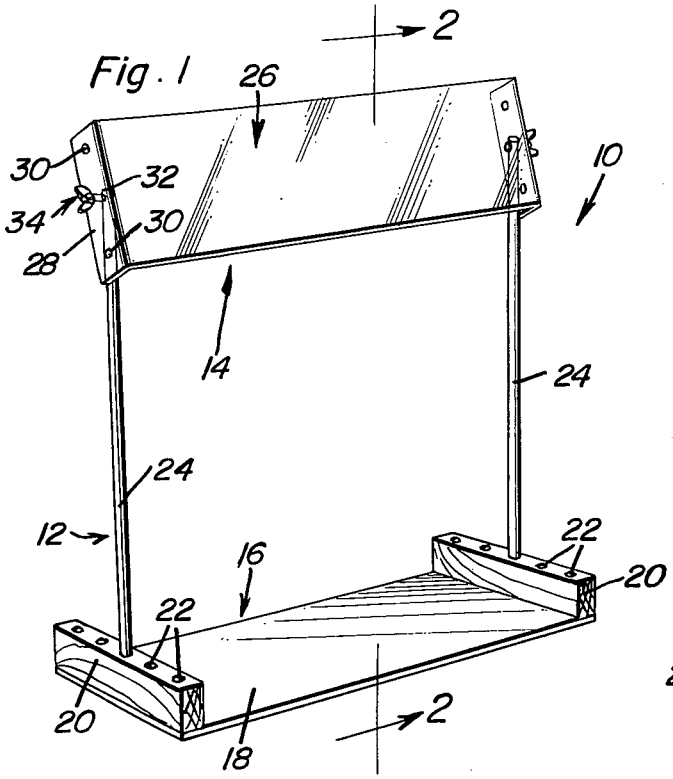
FIG. 1 is a perspective view showing a golf chipping and putting trainer according to the present invention.
Figure 2:
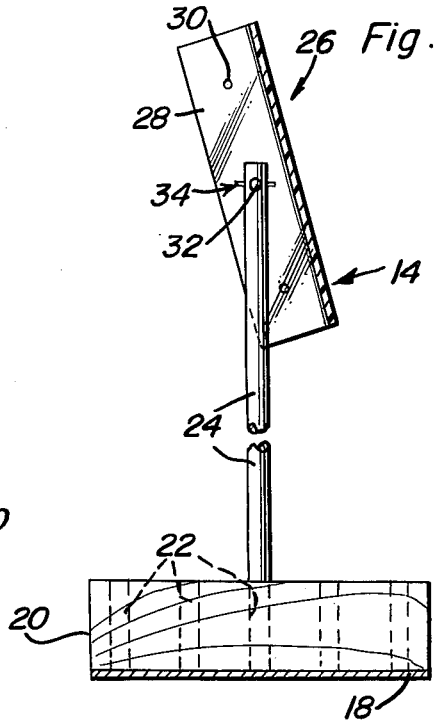
FIG. 2 is an enlarged, fragmentary, sectional view taken generally along the line 2—2 of FIG. 1.

Referring now more particularly to FIGS. 1 and 2 of the drawings, a golf chipping and putting trainer 10 according to the present invention includes a support 12 on which is adjustably mounted a guide 14 arranged for forcing a golfer to swing in a straight line.

Support 12 includes a longitudinally extending base member 16 comprising a longitudinally extending plate 18 having longitudinally spaced end portions at which are mounted a pair of pole mounting blocks 20. Each of the blocks 20 is provided with a plurality of sockets 22 matched with a corresponding socket in the other of the blocks 20 and arranged for receiving a respective one of a pair of poles 24. The latter are removably disposed in a selected one of the pairs of sockets 22 provided in blocks 20 and are attached to guide 14 for supporting guide 14 in spaced relation above plate 18 of base member 16. The plurality of pairs of sockets 22 provided in the blocks 20 permit adjustment of guide 14 relative to plate 18, with the latter forming a support surface for a golfer using trainer 10.

Guide 14 includes a longitudinally extending member 26 coextensive with plate 18 of base member 16 and arranged forming a planar guide surface defining a path for the hands and wrists of a golfer using trainer 10.

Member 26 comprises a self-supporting, longitudinally extending, planar sheet having spaced ends terminating in codirectionally extending flanges 28 disposed substantially perpendicularly to the plane of the sheet forming the extent of member 26. Each of these flanges 28 is provided with a plurality of holes 30, with the poles 24 each having a portion arranged upwardly of the device and provided with an aperture selectively mateable with any one of the holes 30 provided in an associated one of the flanges 28. Support 12 further includes suitable fasteners 34 for selectively and adjustably attaching the member 26 to poles 24 in such a manner as to permit variation in the angle which the plane of the sheet portion of member 26 forms relative to the longitudinal extent of poles 24 and the plane of plate 18 so as to adjust the orientation of guide 14 for each individual using trainer 10.

Figure 3:
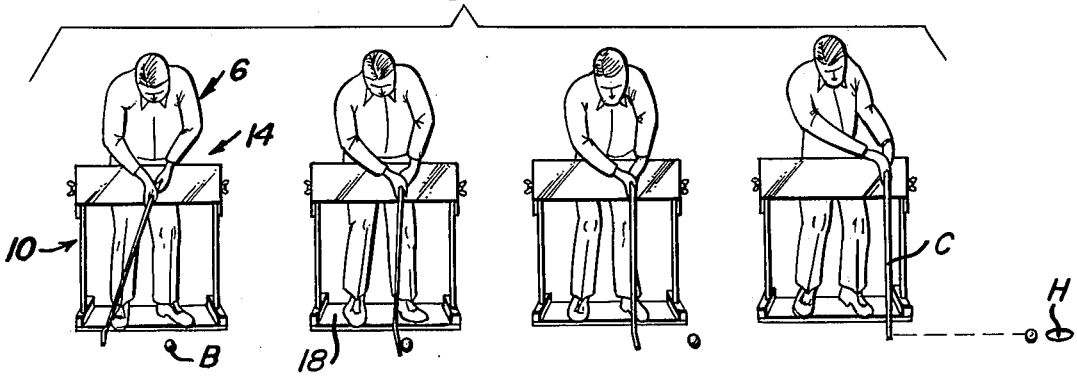
FIG. 3 is a diagrammatic view showing a sequence of the stages in a putting stroke by one using the training device according to the present invention.
Figure 4:
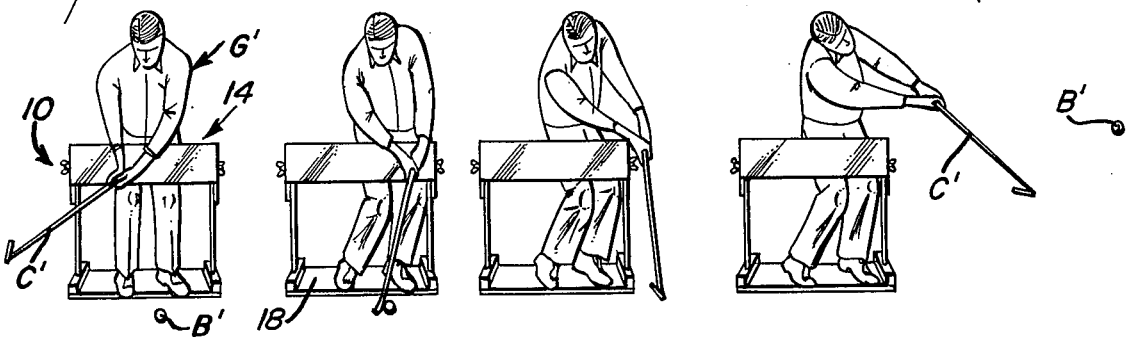
FIG. 4 is a diagrammatic view, similar to FIG. 3, but showing the various stages in a chipping stroke by one using the training device according to the present invention.

FIG. 3 shows the sequence of stages in a putting stroke using trainer 10, while FIG. 4 shows a sequence of stages similar to FIG. 3, but illustrating the manner in which trainer 10 forces one to make a proper chipping stroke. More specifically, in FIG. 3, it will be noted that golfer G strokes ball B using a conventional putter C toward a cup or hole H by maintaining the left hand shoulder of the golfer G as seen looking at FIG. 3, in a constant relationship with the left hand edge of guide 14. Further, FIG. 3 shows the manner in which the club C is to be held and swung back and forth with the arms of golfer G, with guide 14 forcing the arms of golfer G to follow a straight path. If the arms of the golfer are forced to follow the appropriate path during the putting stroke, the shoulders of golfer G will tend to remain in the proper fixed position as is necessary for a correct putting stroke.

In a like manner, FIG. 4 shows that the head of a golfer G′ remains in the necessary fixed position relative to guide 14 during a chipping stroke. Note the position of the hands and wrists in FIG. 4 as the stroke proceeds through its various stages, since the curvature of the wrists in particular is very important to a chipping stroke. Further, while the feet of golfer G in FIG. 3 remain in the same position throughout the stroke, and the club C remains substantially vertical so as to be generally parallel with the poles 24 during contact and follow through of the putting stroke, in the chipping stroke, as shown in FIG. 4, the knee and leg action is important as illustrated. Only the head remains in a fixed position throughout the swing in a chipping stroke. Thus, the club C′ used in the chipping stroke follows through toward the ball B′ being stroked, with the knees of the golfer G′ following through in essentially the same direction. In both the putting and chipping strokes, however, it is the presence of the planar guide surface formed by guide 14 that causes the arms of a golfer G, G′ to swing the putter C or chipping iron C′ back and forth in a straight line.

As can be readily understood from the above description and from the drawings, a golf chipping and putting trainer according to the present invention permits one to learn the appropriate manner of swinging a putter or chipping iron by use of a simple, yet rugged and reliable device that simulates as nearly as possible conditions actually encountered on the golf course during the playing of a round of golf.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A golf chipping and putting trainer, comprising, in combination:

(a) a support assembly extending above a support surface; and (b) guide means mounted on the support assembly and disposed spaced above the support surface for forcing the arm of a golfer swinging an untethered golf club at a ball on the support surface to pass along the guide means and swing in a straight line, the support assembly including a longitudinally extending base member provided with a pair of longitudinally spaced sockets, and poles removably disposed in the sockets and attached to the guide means for supporting the guide means in spaced relation above the base member, the base member comprising a longitudinally extending plate having longitudinally spaced end portions, and pole mounting blocks mounted on the plate at the end portions, with each of the mounting blocks being provided with a plurality of sockets spaced transversely of the extent of the base member and arranged for selectively receiving the poles and permitting adjustment of the guide means relative to the plate, the plate forming a feet positioning surface for a golfer using the trainer, the guide means including a longitudinally extending member coextensive with the base member and forming a planar guide surface defining a path above the golfer's knees for the arms of a golfer using the trainer, the longitudially extending member comprising a self-supporting, longitudinally extending, planar sheet having spaced ends terminating in codirectionally extending flanges disposed substantially perpendicularly to the plane of the sheet, each of the flanges being provided with a plurality of holes, the poles each having upper portions provided with an aperture mating with one of the holes provided in the associated one of the flanges, and the support further including wing nut fasteners means for selectively and adjustably attachably attaching the sheet to the poles, and the lower edge of said planar sheet being located a substantial distance above said base member and not connected thereto whereby said planar sheet including said lower edge may be angularly adjusted relative to said base member.

2. A method of using the apparatus as recited in claim 1 for learning to use the hands and arms properly during a golf swing, comprising the steps of:

(a) placing said planar guide surface adjacent to and spaced above a ball to be hit a distance placing the guide surface in the path of a golfer's arms during a swing motion;

(b) standing in a proper golfing stance adjacent the planar surface and away from the ball to be hit so as to cause the hands to pass over and along the guide surface as the golf club is swung; and (c) swinging an untethered golf club held by the golfer's arms, which pass along and are guided by the planar guide surface, and striking the ball with the golf club.

* * * * *